US012687125B1

(12) United States Patent
Shah et al.

(10) Patent No.: US 12,687,125 B1
(45) Date of Patent: Jul. 21, 2026

(54) EXHAUST SYSTEM AND METHOD OF OPERATING THE SAME

(71) Applicant: SAUDI ARABIAN OIL COMPANY, Dhahran (SA)

(72) Inventors: Ashish Dinesh Shah, Canton, MI (US); Rafael Lago Sari, Commerce Township, MI (US); David Cleary, West Bloomfield, MI (US)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 19/190,256

(22) Filed: Apr. 25, 2025

(51) Int. Cl.
*F01N 3/22* (2006.01)
*F01N 3/20* (2006.01)
(Continued)

(52) U.S. Cl.
CPC ..... *F01N 3/222* (2013.01); *F01N 3/20* (2013.01); *F01N 3/225* (2013.01); *F01N 9/00* (2013.01);
(Continued)

(58) Field of Classification Search
CPC combination set(s) only.
See application file for complete search history.

(56) References Cited

U.S. PATENT DOCUMENTS 5,130,099 A * 7/1992 Schatz ..... F01N 3/2882 422/175
5,553,451 A 9/1996 Harada
(Continued)

FOREIGN PATENT DOCUMENTS

CN 103835793 A 6/2014
CN 112922702 A 6/2021
(Continued)

OTHER PUBLICATIONS

O.J. Murphy et al., "Electrically Initiated Chemically Heated Catalytic Converter to Reduce Cold-Start Emissions from Automobiles," SAE Technical Paper Series, pp. 1-11, Jan. 3, 1999 (13 pages).
(Continued)

*Primary Examiner* — Binh Q Tran
(74) *Attorney, Agent, or Firm* — Osha Bergman Watanabe & Burton LLP

(57) ABSTRACT

A system includes an exhaust discharge line, first and second junctions, an after-treatment system, an exhaust recirculation line, a pressurized exhaust storage tank, first, second, and third control valves, and an Electronic Control Unit (ECU). The first and second junctions are disposed along the exhaust discharge line, and the control valves are disposed in the exhaust discharge line or the exhaust recirculation line. The ECU is communicatively coupled to the after-treatment system and the control valves. The ECU executes a filling phase by opening or closing the valves to accumulate a portion of the exhaust gases in the storage tank. The ECU ends the filling phase when the tank pressure exceeds a predetermined pressure threshold. The ECU opens the third control valve to release the portion of exhaust gases in response to a determination that the temperature of the catalytic converter exceeds a light-off temperature of the catalytic converter.

20 Claims, 5 Drawing Sheets

(51) Int. Cl.
*F01N 9/00* (2006.01)
*F01N 13/08* (2010.01)

(52) U.S. Cl.
CPC ..... *F01N 13/08* (2013.01); *F01N 13/087* (2013.01); *F01N 2410/03* (2013.01); *F01N 2410/06* (2013.01); *F01N 2410/14* (2013.01); *F01N 2550/06* (2013.01); *F01N 2560/08* (2013.01); *F01N 2900/1404* (2013.01); *F01N 2900/1406* (2013.01)

(56) References Cited

U.S. PATENT DOCUMENTS

| | | | | |
|---|---|---|---|---|
| 6,164,063 | A | 12/2000 | Mendler | |
| 6,250,073 | B1 * | 6/2001 | Zimmer | F02M 26/37 60/281 |
| 10,578,039 | B2 | 3/2020 | McKay et al. | |
| 11,193,411 | B2 | 12/2021 | Paukner et al. | |
| 2003/0233825 | A1 * | 12/2003 | Asanuma | F01N 3/2013 60/299 |
| 2007/0089715 | A1 * | 4/2007 | Kolavennu | F02D 35/023 123/58.8 |
| 2009/0120063 | A1 | 5/2009 | Uhrich et al. | |
| 2010/0212415 | A1 * | 8/2010 | Miller | F23K 5/007 73/114.75 |
| 2014/0261342 | A1 | 9/2014 | Kolhouse et al. | |
| 2016/0146161 | A1 * | 5/2016 | Sun | F01N 3/021 60/311 |
| 2016/0369675 | A1 * | 12/2016 | Mori | F01N 3/0871 |
| 2018/0106205 | A1 * | 4/2018 | Jammoussi | F01N 13/107 |

FOREIGN PATENT DOCUMENTS

| | | | |
|---|---|---|---|
| DE | 102019201048 | A1 | 7/2020 |
| KR | 101735216 | B1 | 5/2017 |

OTHER PUBLICATIONS

M.A. Marston et al., "A Novel Automobile Preheating System for Cold Starts," SAE Technical Paper Series, pp. 1-10, Oct. 17, 1994 (10 pages).

J.R. Theis et al., "An assessment of low temperature NO adsorbers for cold-start NO control on diesel engines," Catalysis Today, vol. 258, part 2, pp. 367-377, Dec. 1, 2015 (10 pages).

* cited by examiner

EXHAUST SYSTEM AND METHOD OF OPERATING THE SAME

BACKGROUND

Stringent emissions requirements imposed on vehicles by government authorities require advancements in engine thermal efficiency and emissions after-treatment systems. It is well-known that in modern engines with after-treatment systems, the majority of the emission expelled from the tailpipe is generated during times when the catalytic converter of the after treatment is below an optimal temperature. Many of the proposed strategies for quickly heating the catalytic converter require the addition of expensive hardware that may not be robust across various operating conditions or across the lifetime of the engine. In order to comply with current and future emission standards, it is desirable to develop affordable and reliable systems capable of quickly heating catalytic converters in after-treatment systems.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Embodiments disclosed herein generally relate to a system. The system includes an exhaust discharge line configured to receive exhaust gases from an engine, a first junction disposed at a first location along the exhaust discharge line, and a second junction disposed at a second location along the exhaust discharge line downstream of the first location and fluidically coupled to a tailpipe. In addition, the system includes an after-treatment system disposed between the first junction and the second junction, the after-treatment system configured to reduce pollutants comprising Nitrogen Oxides (NOx) in the exhaust gases from the engine using a catalytic converter. The system further includes an exhaust recirculation line fluidically coupled to the first junction and the second junction of the exhaust discharge line and a pressurized exhaust storage tank disposed along the exhaust recirculation line. The system yet further includes a first control valve disposed in the exhaust discharge line downstream of the second junction, a second control valve disposed in the exhaust recirculation line between the second junction and the pressurized exhaust storage tank, and a third control valve disposed in the exhaust recirculation line between the pressurized exhaust storage tank and the first junction. Each of the first control valve, the second control valve, and the third control valve includes butterfly valves having an aperture of configurable diameter occupying a state inclusively between open and closed.

The system also includes an electronic control unit (ECU) comprising a memory and at least one processor, where the ECU is communicatively coupled to the after-treatment system, the first control valve, the second control valve, and the third control valve, and the processor is configured to execute commands stored on the memory that include the following steps. The steps include executing a filling phase by at least partially closing the first control valve, opening the second control valve, and closing the third control valve to accumulate a portion of the exhaust gases in the pressurized exhaust storage tank, thereby increasing a tank pressure of the pressurized exhaust storage tank, and increasing a system pressure of the after-treatment system and pressure heating the catalytic converter. The steps further include determining, with a pressure sensor, whether the tank pressure exceeds a predetermined pressure threshold, and ending the filling phase by at least partially closing the second control valve and at least partially opening the first control valve, while maintaining the tank pressure, in response to the determination that the tank pressure exceeds the predetermined pressure threshold. The steps yet further include measuring a temperature of the catalytic converter, determining a maximum predicted conversion capacity of the after-treatment system based, at least in part, on the temperature of the catalytic converter, and determining whether the temperature of the catalytic converter exceeds a light-off temperature of the catalytic converter. The steps also include opening the third control valve to release the portion of exhaust gases in response to the determination that the temperature of the catalytic converter exceeds the light-off temperature. The third control valve is opened to an aperture that provides a flow rate across a predetermined unit of time less than or equal to the maximum predicted conversion capacity of the after-treatment system.

Embodiments disclosed herein also generally relate to a method. The method includes executing a filling phase that includes the following steps. The steps include receiving exhaust gas from an engine at a first junction disposed at a first location of an exhaust discharge line and transporting the exhaust gas through an after-treatment system disposed downstream of the first junction and to a second junction. The second junction is disposed at a second location of the exhaust discharge line downstream of the after-treatment system. The steps further include at least partially closing a first control valve disposed downstream of the second junction to direct the exhaust gas away from a tailpipe and towards an exhaust recirculation line fluidically coupled to the first junction and the second junction of the exhaust discharge line. The exhaust recirculation line includes a pressurized exhaust storage tank. The steps yet further include opening a second control valve disposed between the second junction and the pressurized exhaust storage tank and closing a third control valve disposed between the pressurized exhaust storage tank and the first junction. Each of the first control valve, the second control valve, and the third control valve include butterfly valves having an aperture of configurable diameter occupying a state inclusively between open and closed. The steps include accumulating a portion of exhaust gases in the pressurized exhaust storage tank thereby increasing a tank pressure of the pressurized exhaust storage tank, increasing a system pressure of the after-treatment system, and pressure heating a catalytic converter, and determining, with a pressure sensor, whether the tank pressure exceeds a predetermined pressure threshold.

The steps also include ending the filling phase by at least partially closing the second control valve and at least partially opening the first control valve, while maintaining the tank pressure, in response to the determination that the tank pressure exceeds the predetermined pressure threshold. The steps further include obtaining a temperature of the catalytic converter using an after-treatment system temperature sensor, determining a maximum predicted conversion capacity of the after-treatment system based, at least in part, on the temperature of the catalytic converter, determining whether the temperature of the catalytic converter exceeds a light-off temperature of the catalytic converter, and opening the third control valve to release the portion of exhaust gases in response to the determination that the temperature of the catalytic converter exceeds the light-off temperature. The third control valve is opened to an aperture that provides a flow rate across a predetermined unit of time less than or equal to the maximum predicted conversion capacity of the after-treatment system.

Any combinations of the various embodiments and implementations disclosed herein can be used in a further embodiment, consistent with the disclosure. Other aspects and advantages of the claimed subject matter will be apparent from the following description and the claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not intended to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the invention are directed towards an untreated exhaust retention and recirculation system ("exhaust system") for vehicles that rely, at least partially, on combustion engines. Subsystems of the exhaust system generally include an after-treatment system including a catalytic converter, a pressurized exhaust storage tank, and an electronic control unit. Multiple configurations of the subsystems are proposed with the objectives of mitigating tailpipe pollutant emissions slip generated from the combustion engine (e.g., nitrogen oxides (NOx) and carbon monoxide, as well as other hydrocarbons and particulate matter, etc.), and accelerating heating of the catalytic converter warmup during cold ambient operation. The proposed methods and systems may also be used during an extended idling of the vehicle.

Figure 1:
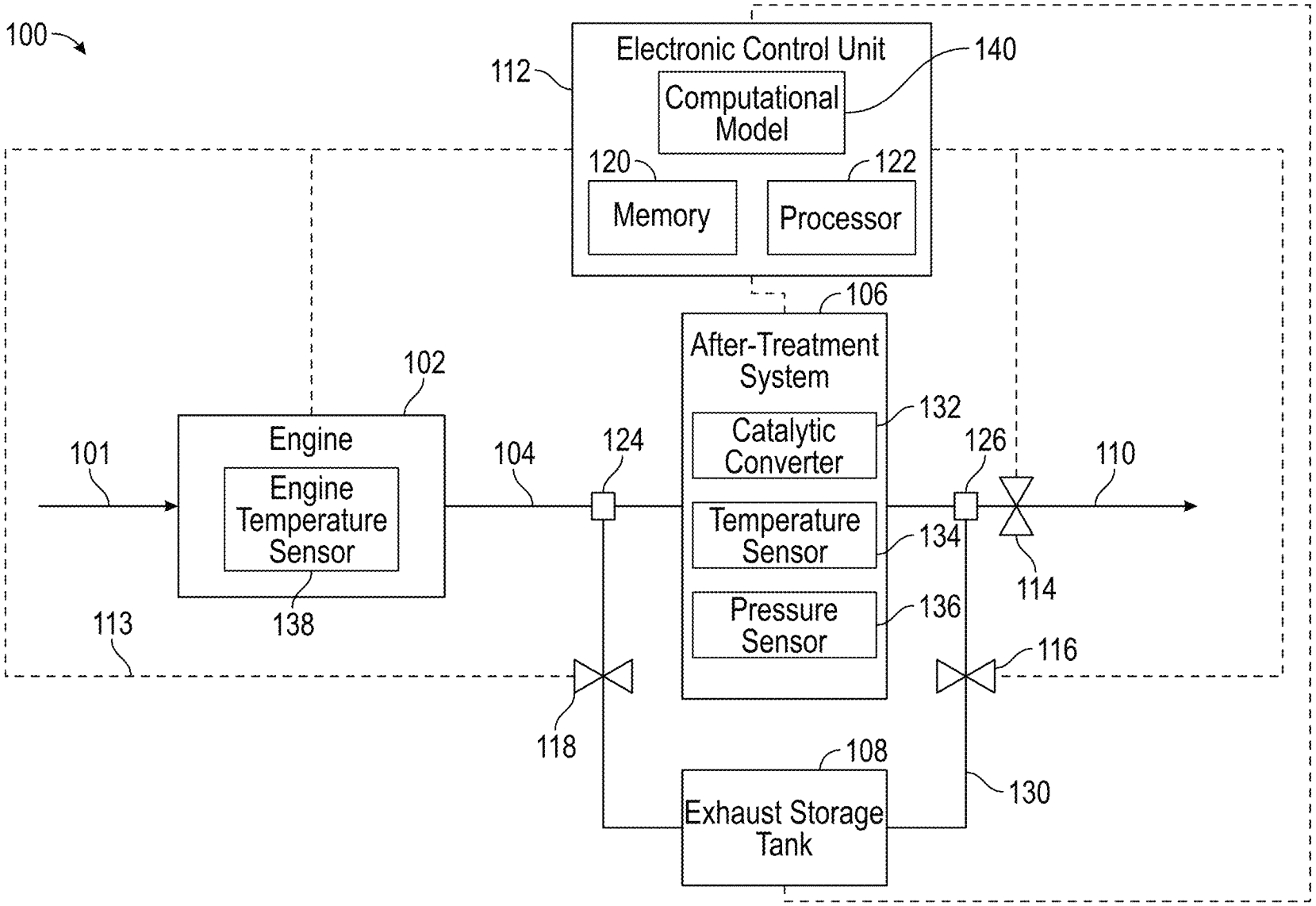
FIG. 1 depicts a block diagram of an exhaust system in accordance with one or more embodiments of the present disclosure.

FIG. 1 depicts an example of an exhaust system (100) in accordance with one or more embodiments of the present disclosure. The exhaust system (100) includes a number of subsystems including, but not limited to, an after-treatment system (106), a pressurized exhaust storage tank (108), and electronic control unit (112), which are each discussed further below.

As depicted, an intake line (101) provides air and fuel to a combustion engine (102) that combusts the fuel in a plurality of cylinders (not shown) to produce power at a rotating output shaft, commonly referred to as a crankshaft (not shown). The engine (102) may be a component of a light-duty vehicle and have a volume of approximately 2 L (e.g., within 20%). Further, the engine may be a component of a medium-duty vehicle and have a volume accordingly sized (e.g., 2-10 L) to handle the volumetric flow rate of the exhaust system. However, embodiments of the present disclosure are applicable to vehicles and engines of other sizes, including heavy-duty vehicles. The temperature of the engine (102) is monitored by an engine temperature sensor (138), which is embodied as a thermistor, a thermopile, or a thermostat. Exhaust from the engine is expelled through an exhaust discharge line (104), embodied as a metal pipe, fluidically coupled to the engine (102). The exhaust discharge line (104) includes a first junction (124) disposed at a first location along the exhaust discharge line (104) and a second junction (126) disposed at a second location along the exhaust discharge line, downstream of the first location. An after-treatment system (106) is disposed between the first junction (124) and the second junction (126). The after-treatment system (106) is configured to, at least, reduce the pollutants content (e.g., the NOx content) in the exhaust gases from the engine using a catalytic converter (132). More specifically, the after-treatment system may include a three-way oxidation catalyst configured to oxidize Carbon Monoxide (CO) in the exhaust gases, a particulate filter configured to remove soot from the exhaust gases, and a selective catalytic reduction (SCR) catalyst configured to convert the NOx in the exhaust gases into Nitrogen (N) and water ($H_2O$). In one or more embodiments, for example, embodiments including stoichiometric gasoline engines, the after-treatment system may include a three-way catalytic converter configured to oxidize CO and HydroCarbons (HC) as well as reduce NOx content, thereby replacing the need for a separate SCR. In alternative embodiments, such as those using a lean burning engine, may utilize one or more oxidation catalysts to oxidize CO and HC pollutants, as well as a Selective Catalyst Reduction (SCR) device to remove NOx pollutants. A person of ordinary skill in the art will appreciate that the scope of this disclosure is not limited by the particular configuration of the engine. In addition, the after-treatment system (106) includes an after-treatment system temperature sensor (134) and a pressure sensor (136).

The second junction is fluidically coupled to a tailpipe (110) that provides a passageway from the exhaust system (100) to the external environment. Between the second junction (126) and tailpipe (110) is a first control valve (114).

An exhaust recirculation line (130) is fluidically coupled to the first junction (124) and the second junction (126) of the exhaust discharge line (104). A pressurized exhaust storage tank (108) is disposed along the exhaust recirculation line (130). A second control valve (116) is disposed in the exhaust recirculation line (130) between the second junction and the pressurized exhaust storage tank (108). Similarly, a third control valve (118) is disposed in the exhaust recirculation line (130) between the pressurized exhaust storage tank (108) and the first junction (124). Each of the first control valve (114), the second control valve (116) and the third control valve (118) include butterfly valves that have an aperture of configurable diameter occupying a state inclusively between open and closed. Said differently, by changing the diameter of the aperture of the butterfly valve, each control valve (114, 116, 118) may be configured to fully open, fully close, or occupy any state in between (e.g., 5% open, 10% open, 50% open, 80% open, etc.).

An electronic control unit (112), or ECU, is communicatively coupled to many of the components of the exhaust system (100). The ECU (112) includes one or more processors, microprocessors, logic units, controllers, and/or integrated circuits that receive, process, and transmit commands to operate components of the vehicle in which the exhaust system (100) is configured, or primarily for the exhaust system (100) itself. A person of ordinary skill in the art will appreciate that vehicles often have multiple ECUs, and that although only one ECU (112) is depicted, additional ECUs may be present without limitation. Generally, components are communicatively coupled to the ECU through electronic communication networks facilitated by either wired or wireless connections. Popular communication protocols include a controller area network (CA N) through which a plurality of individual microcontrollers communicate with each other via two wires without a host computer and allowing for any node (microcontroller) to communicate with the others. Alternatively, the electronic control unit may communicate through a local interconnect network, FlexRay communication, media-oriented systems transport (MOST), and automative ethernet communication. In some embodiments, electronic communication may be supported wirelessly, for example, through Bluetooth.

In FIG. 1, electronic communication is depicted as a data connection (113) that extends as dotted lines connecting various components to the ECU (112). As depicted, the ECU is communicatively coupled through the electronic communication that is provided by the data connection (113) to the engine (102), the after-treatment system (106), the pressurized exhaust storage tank (108), as well as the first control valve (114), the second control valve (116), and the third control valve (118).

The ECU (112) includes a memory (120) including a non-transitory storage medium such as flash memory, a Hard Disk Drive (HDD), a solid-state drive (SSD), a combination thereof, or equivalent storage devices. The memory (120) stores computer readable instructions or commands, executed by a processor (122), that controls the various hardware components of the exhaust system (100). The memory (120) further stores instructions to receive data from the various sensors (e.g., engine temperature sensor (138), after-treatment system temperature sensor (134), pressure sensor (136)). The processor (122) is formed by one or more processors, integrated circuits, microprocessors, or equivalent computing structures that serve to execute the computer readable instructions stored on the memory (120).

The commands stored on the memory (120) of the ECU (112) may be executed during operation of the vehicle and the exhaust system (100). During operation, exhaust gas is received from the engine (102) through the first junction (124) after which the gas is transported through the after-treatment system (106). As described above, the after-treatment system (106) is configured, at least, to reduce NOx content in the exhaust gases from the engine (102) using a catalytic converter (132). Again, it is to be understood that the after-treatment system may also reduce other pollutants in the exhaust gases, such as CO. However, the volumetric flow rate at which the catalytic converter (132) is able to successfully limit the NOx content (and other pollutants) depends on both the size of the catalytic converter (132) but also its temperature. As is well known, the majority of harmful emissions from exhaust systems that include after-treatment systems are produced when the temperature of the catalytic converter is too low. By contrast, the maximum conversion efficiency for a catalytic converter (132) of a fixed size is achieved above a temperature threshold referred to as the light-off temperature. Generally, the light-off temperature delineates the temperature at which the conversion efficiency of the catalytic converter (132) reaches 50%. Thus, if the temperature of the catalytic converter is low when the exhaust gas reaches the after-treatment system, then the exhaust system (100) may be used to first perform a filling phase that directs untreated exhaust gas to the pressurized exhaust storage tank (108) and results in rapidly heating the catalytic converter (132) to achieve its light-off temperature while also limiting the release of pollutants into the atmosphere.

The filling phase may be executed by the processor (122) of the ECU (112) according to commands stored in the memory (120). Generally, the indication to begin the filling phase is that the temperature of the catalytic converter (132) is below the light-off temperature. However, the ECU (112) is configured to receive a temperature measurement from either the engine temperature sensor (138) or the after-treatment system temperature sensor (134), or both, and thus may determine to begin the filling phase based on the inferred temperature of the exhaust gases instead of the temperature of the catalytic converter (132) explicitly. After exhaust gas passes through the after-treatment system (106), the filling phase continues with closing the first control valve (114) thereby directing exhaust gas to the exhaust recirculation line (130). At the same time (i.e., substantially simultaneously) that the first control valve (114) is closed, the second control valve is opened (116) and the third control valve (118) is closed, allowing for the exhaust gas to travel to the exhaust storage tank (108). During the filling phase, a portion of the exhaust gas accumulates in the pressurized exhaust storage tank (108), thereby increasing a tank pressure of the pressurized exhaust storage tank (108), increasing a system pressure of the after-treatment system (106), and pressure heating the catalytic converter (132).

While the portion of exhaust gas accumulates in the pressurized exhaust storage tank (108), the tank pressure of the exhaust storage tank (108) and the system pressure of the after-treatment system (106) is monitored by the ECU (112) using the pressure sensor (136). During the filling phase, the tank pressure and the system are substantially equal because the first control valve (114) is closed. While monitoring the system pressure, the ECU (112) compares the tank pressure to a predetermined pressure threshold, and the portion of exhaust gas continues to accumulate in the exhaust storage tank (108) until the tank pressure exceeds a predetermined pressure threshold. The predetermined pressure threshold is based on the properties of the pressurized exhaust storage tank (108), such as a safe operating limit. Alternatively, or in addition, the predetermined pressure threshold may be based on the backpressure limit of the engine (102), which is typically between 0-3 bar (0-300 kPa). Considering the backpressure limit of the engine (102) may be important because, as previously stated, the system pressure and the tank pressure are substantially equal while the first control valve (114) is closed and the second or third control valves (116, 118) are opened. However, a person of ordinary skill in the art will appreciate that additional predetermined pressure thresholds may be specified. For example, a large, pressurized exhaust storage tank (108) may have a volume of approximately 37.5 L (within 20%). With proper construction and material (e.g., aluminum or steel), the predetermined pressure threshold of the pressurized exhaust storage tank (108) may be 2 bar.

The filling phase ends in response to the determination that the tank pressure exceeds the predetermined pressure threshold. Ending the filling phase includes at least partially closing the second control valve (116) and at least partially opening the first control valve (114). The amounts to which the first control valve (114) is opened and the amount to which the second control valve (116) is closed is determined by the ECU (112) such that the tank pressure of the exhaust storage tank (108) is maintained. Due to the filling phase, the elevated system pressure has effectuated pressure heating in the catalytic converter (132), thereby elevating its temperature. In some instances, the filling phase fully heats the catalytic converter (132) to the light-off temperature. However, in other instances, the filling phase alone may not sufficiently heat the catalytic converter depending on the characteristics of the engine (102), exhaust storage tank (108), and after-treatment system (106). Nonetheless, exhaust gas that travels from the engine (102) through the exhaust discharge line (104) and after-treatment system (106) at this time may be at least partially treated to reduce the pollutants content of the exhaust gases (e.g., the NOx content) because the temperature of the catalytic converter (132) has increased.

The untreated portion of exhaust gas that has accumulated in the exhaust storage tank (108) generally remains stored until the light-off temperature is achieved, which may not occur during the filling phase. Accordingly, the ECU (112) monitors the temperature of the catalytic converter (132) using the temperature sensor (134) both during and after the filling phase. As the temperature of the exhaust gases rise, due to the engine temperature increasing, the catalytic converter (132) continues to heat.

The ECU (112) uses the temperature of the catalytic converter (132), as measured by the after-treatment system (106) temperature sensor (134), to determine a maximum predicted conversion capacity of the after-treatment system (106). In one or more embodiments, the maximum predicted conversion capacity is determined using a computational model (140) of the after-treatment system (106). In such embodiments, the computational model (140) is part of the ECU (112). The computational model (140) is defined by a set after-treatment system parameters that includes the size of the catalytic converter, and may comprise an empirical model using lookup tables, a physics driven feedback model, or an Artificial Intelligence (AI) model or Machine L earning (M L) model, where each type of model has separate advantages and disadvantages. The set of after-treatment system parameters may include several additional parameters, for example, the expected chemical composition of the exhaust gases, the temperature of the exhaust gases (e.g., according to the engine temperature sensor (138)), the flow rate through the after-treatment system (106), properties of the catalysts used in the catalytic converter (132) such as their material (e.g., platinum, palladium, rhodium), geometric properties of the catalytic converter (e.g., length, diameter, surface area, cell density), the expected pressure drop through the catalytic converter, and also the age of the catalytic converter, among others not listed.

Eventually, the ECU (112) determines catalytic converter (132) has reached the light-off temperature. At this time, the third control valve (118) is at least partially opened. More specifically, the third control valve is opened to an aperture that provides a flow rate across a predetermined unit of timeless than or equal to the maximum predicted conversion capacity of the after-treatment system (106). The flow rate under consideration may include both the flow rate of the portion of exhaust gas exiting the pressurized exhaust storage tank (108) as well as the general flow of exhaust gas exiting the engine (102). The predetermined unit of time may correspond to the average amount of time for exhaust gases to traverse the after-treatment system (106). Alternatively, the predetermined unit of time may correspond to the maximum or the minimum amount of time in which exhaust gases are observed to traverse the after-treatment system (106). In any case, the flow rate multiplied by the predetermined unit of time provides a volume of exhaust gases to be treated by the after-treatment system such that the maximum predicted conversion capacity is not exceeded and harmful emission (e.g., NOx) is minimized.

Figure 2:
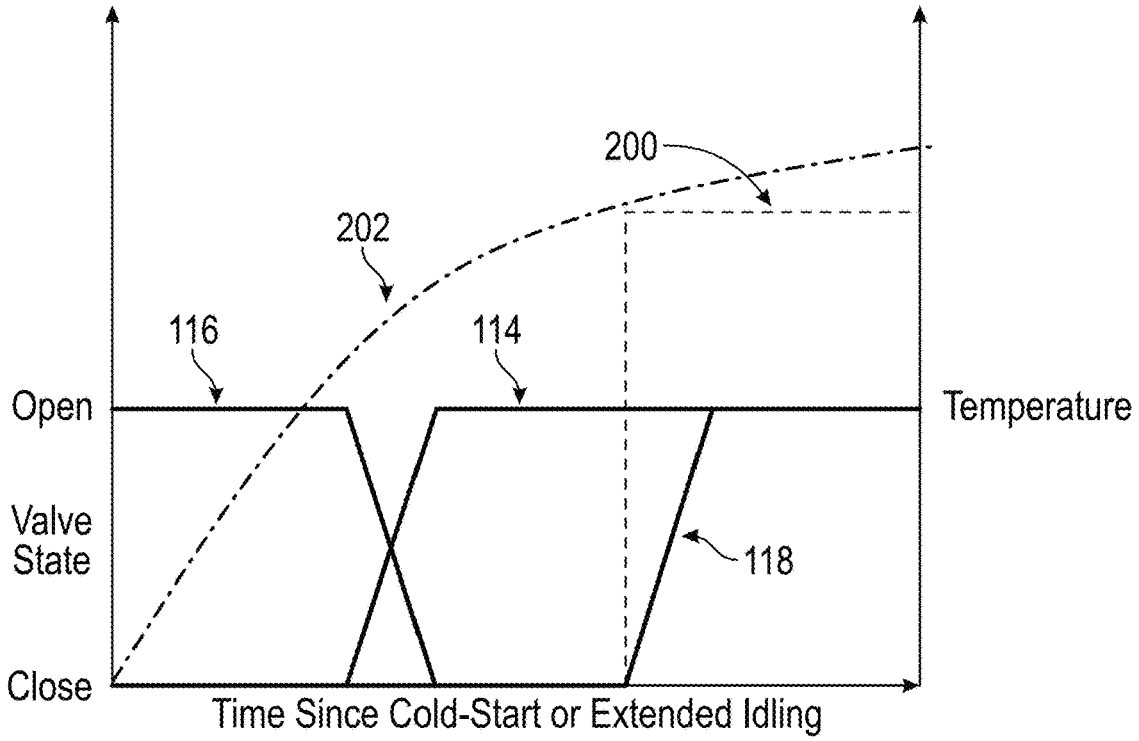
FIG. 2 depicts a scenario of operation in accordance with one or more embodiments of the present disclosure.

FIG. 2 illustrates the timing of the opening and closing of the three control valves (114, 116, 118) as dictated by the ECU (112). As previously noted, the three control valves may include butterfly valves having an aperture of configurable diameter that are therefore capable of occupying a state inclusively between open and closed. FIG. 2 may represent operation of the engine from a "cold start." A cold start generally refers to initiating the operation of the engine (102) and exhaust system (100) from a state of not operating. As such, the temperature (202) of the catalytic converter (132) is initially below the light-off temperature (200). The cold start may initiate the filling phase described above in reference to FIG. 1 and may begin with obtaining, using the ECU (112), an engine temperature from the engine temperature sensor (138). The engine temperature is then compared to an engine temperature threshold, and the filling phase is initiated in response to the engine temperature being lower than the engine temperature threshold. In some instances, the engine temperature is greater than the engine temperature threshold, but the temperature (202) of the catalytic converter (132) has dropped below the light-off temperature (200) due to extended idling. In such a case, the filling phase may also be initiated.

At a moment in time where the temperature (202) of the catalytic converter (132) is below the light-off temperature (e.g., during a cold-start or extended idling), the first control valve is closed, the second control valve (116) is opened, and the third control valve (118) is closed. A portion of exhaust gas accumulates in the pressurized exhaust storage tank (108), increasing the tank pressure of the pressurized exhaust storage tank (108) while also increasing a system pressure of the after-treatment system (106). The increase in the system pressure pressure-heats the catalytic converter, raising the catalytic converter (132) temperature (202). The portion of exhaust gas continues to accumulate until the tank pressure exceeds a predetermined pressure threshold. In response to the tank pressure meeting or exceeding the predetermined pressure threshold, the apertures of the control valves are adjusted such that the second control valve (116) at least partially closes while the first control valve (114) at least partially opens. Eventually, the temperature (202) of the catalytic converter (132) exceeds the light-off temperature (200), which initiates the third control valve to open (118). However, the amount to which the third control valve is opened depends on a prediction of the maximum predicted conversion capacity of the after-treatment system (106). In FIG. 2, the third control valve (118) is depicted as fully opening, which implies that the total flow rate through the after-treatment system (106), including both exhaust gas from the engine and the untreated portion of exhaust gas stored in the pressurized exhaust storage tank (108), across a predetermined unit of time is less than or equal the maximum predicted conversion capacity of the after-treatment system (106). Again, the predetermined unit of time may correspond to the average amount of time for exhaust gases to traverse the after-treatment system (106), the minimum time, or the maximum time. Additional possibilities for the predetermined unit of time are possible, for example, the predetermined unit of time may be assigned by an operator or mechanic based on a requirement of the catalytic converter. In each case, the flow rate multiplied by the predetermined unit of time provides a volume of exhaust gases to be treated by the after-treatment system such that the maximum predicted conversion capacity is not exceeded.

Figure 3:
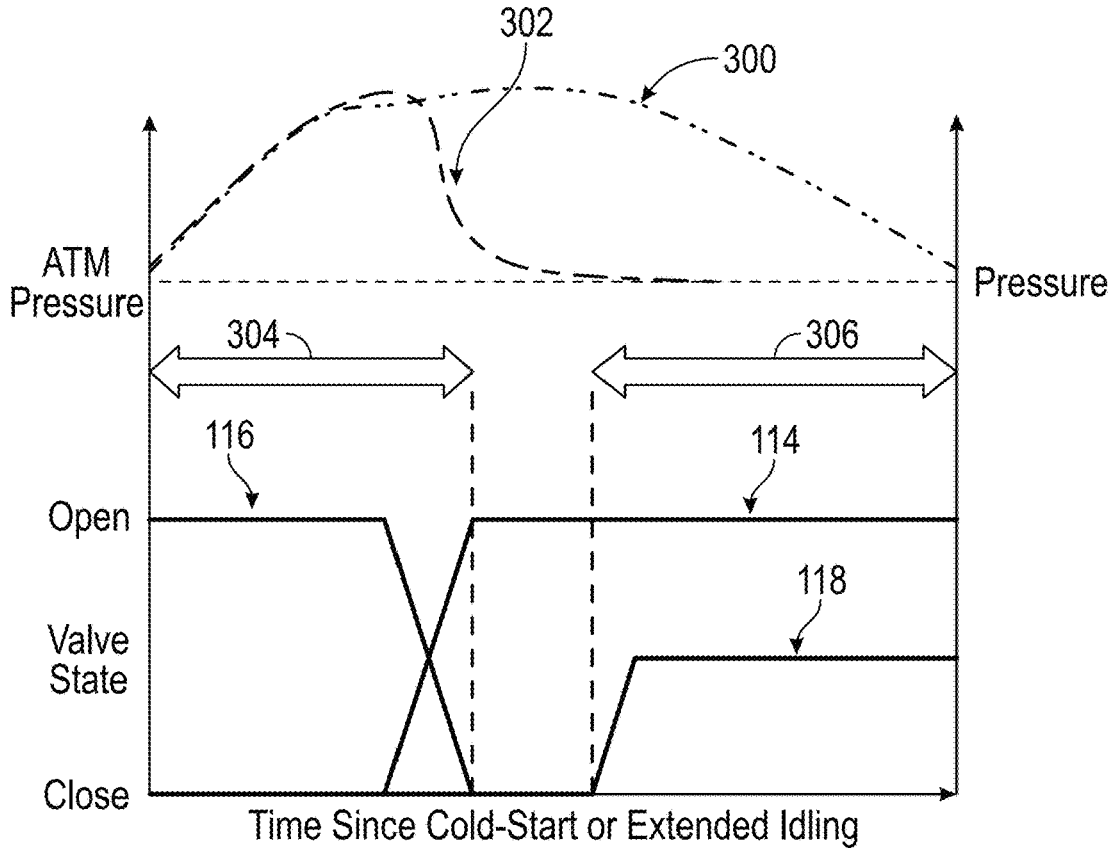
FIG. 3 depicts a scenario of operation in accordance with one or more embodiments of the present disclosure.

FIG. 3 depicts an example of operating the exhaust system (100) in a recirculation phase in accordance with one or more embodiments. The recirculation phase provides a complementary method to the filling phase for heating the catalytic converter (132). Similar to FIG. 2, the scenario depicted by FIG. 3 begins with either a cold-start or an extended idling in which the temperature of the catalytic converter (132) is below the light-off temperature. The recirculation phase follows the filling phase, after filling (304) the pressurized exhaust storage tank (108) with a portion of the exhaust gas by closing the first control valve (114), opening the second control valve (116), and closing the third control valve (118). As the portion of exhaust gas accumulates in the pressurized exhaust storage tank (108), both the tank pressure (300) and the system pressure (302) increase. The portion of exhaust gas that accumulates in the pressurized exhaust storage tank (108) is characterized by a gas pressure that is substantially equal to the tank pressure (300). As described above, the increase system pressure (302) effectuates pressure heating in the catalytic converter (132), raising its temperature.

Keeping with FIG. 3, when the tank pressure (300) reaches a predetermined pressure threshold, the first control valve (114) is at least partially opened, and the second control valve (116) is at least partially closed. The states of each of the first and second control valves (114, 116) maintain the tank pressure (300) by limiting the volumetric flow. In the description provided above (i.e., outside of the recirculation phase), the third control valve (118) remains closed until the temperature of the catalytic converter (132) reaches the light-off temperature. However, in the recirculation phase, the third control valve (118) is at least partially opened in response to the determination that the temperature of the catalytic converter is less than the light-off temperature. In doing so, the portion of exhaust gases stored in the pressurized exhaust storage tank (108) undergoes recirculation (306) by traveling through the exhaust recirculation line (130), passing through the first junction (124), and traveling back through the after-treatment system (106) again. In circulating the portion of exhaust gas, the catalytic converter (132) is further pressure heated due to the elevated gas pressure of the portion of exhaust gas.

Figure 4:
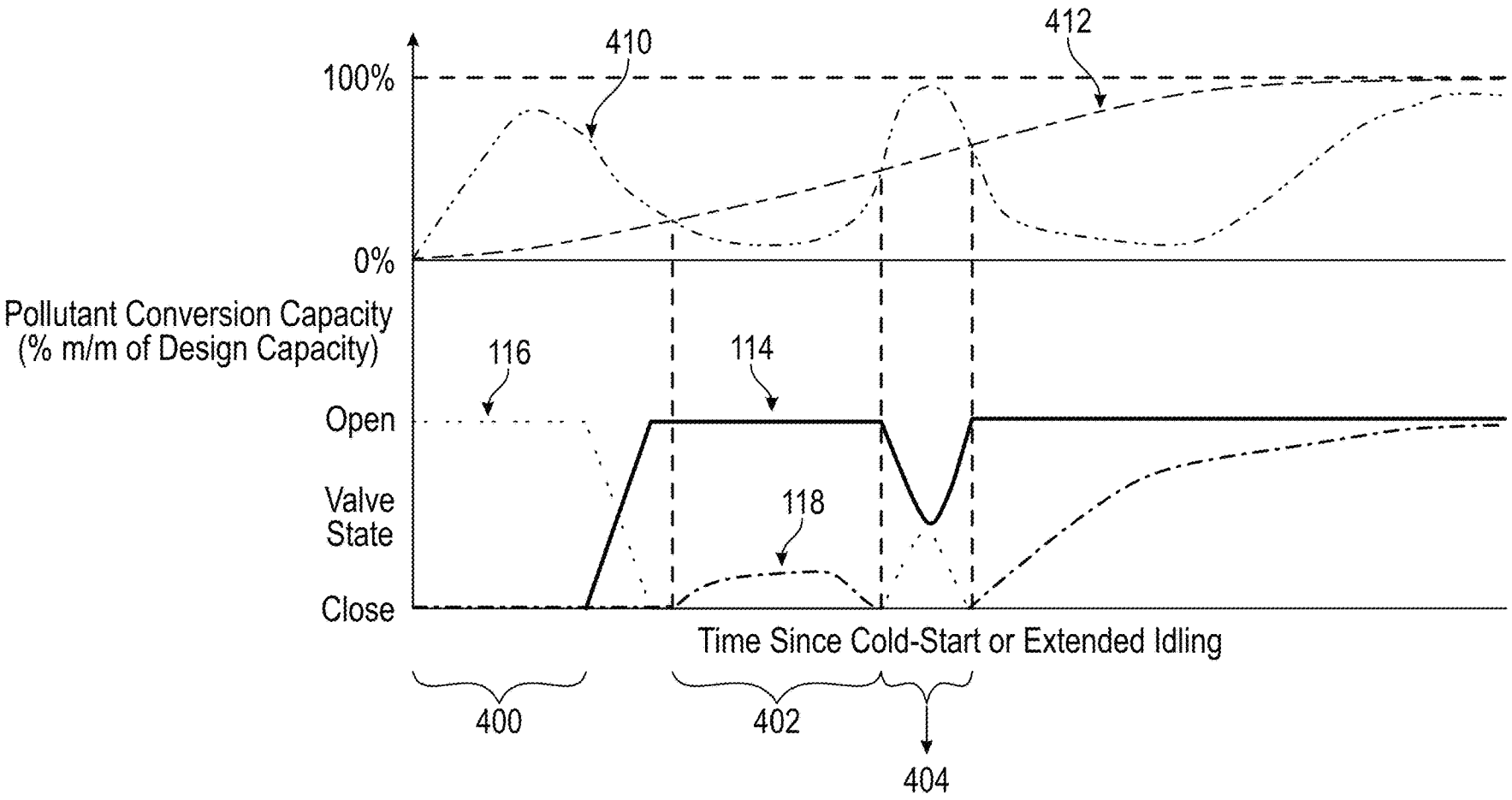
FIG. 4 depicts a scenario of operation in accordance with one or more embodiments of the present disclosure.

FIG. 4 depicts an example of alternating between filling phases and recirculation phases in accordance with one or more embodiments. As with FIGS. 2 and 3, the scenario begins with the engine (102) either undergoing a cold-start or operating under extended idling such that the temperature of the catalytic converter (132) is below the light-off temperature. An initial filling phase (400) is performed in which the first control valve (114) is closed, the second control valve (116) is open, and the third control valve (118) is closed. A portion of exhaust gas accumulates in the pressurized exhaust storage tank (108), increasing the tank pressure of the exhaust storage tank (108) and the system pressure of the after-treatment system (106). As before, the elevated system pressure applies pressure heating to the catalytic converter (132). The portion of exhaust gas also has a gas pressure that rises.

When the tank pressure exceeds a predetermined pressure threshold, the second control valve (116) is at least partially closed, and the first control valve (114) is at least partially opened. As in FIG. 3, a recirculation phase may then be performed, here referred to as a partial release (402), in which the third control valve (118) is at least partially opened to circulate the portion of exhaust gas stored in the pressurized exhaust storage tank (108). The high gas pressure of the portion of exhaust gas that was stored applies further pressure heating the catalytic converter (132) during the partial release (402). Following the partial release (402), another filling phase may be performed, here referred to as a partial fill (404), by closing the third control valve (118), at least partially opening the second control valve (116), and at least partially opening the first control valve (114). These steps may be repeated to rapidly heat the catalytic converter (132).

FIG. 4 also depicts a model-based prediction (412) by the ECU (112). As described in reference to FIG. 1, the ECU (112) may include a computational model (140) of the after-treatment system (106). The model-based prediction (412) by the ECU may estimate the maximum predicted conversion capacity of the catalytic converter (132) based on a set of after-treatment parameters. The set of after-treatment parameters may include the size of the catalytic converter (132), the temperature of the catalytic converter (132), an ambient temperature as measured by an external temperature sensor, the time that has elapsed since the engine (102) was last off, the expected chemical composition of the exhaust gas, or additional parameters not listed. Generally, the state of each of the control valves (114-118) may be determined by the ECU (112), using the computational model (140), in reference to the model-based prediction (412). For example, in FIG. 4, the third control valve (118) slowly transitions from being fully closed to fully opened when the model-based prediction (412) of the predicted conversion capacity is nearly at its peak.

In one or more embodiments, the ECU (112) may use the computational model (140) to predict the engine-out pollutant mass flow (410). In other embodiments, the ECU (112) may be communicatively coupled to a flow meter in the exhaust discharge line to measure the engine-pollutant mass flow (410). Whether it is predicted or observed, the engine-out pollutant mass flow (410) may also be used to inform the ECU (112) regarding the opening and closing of the three control valves (114-118). For example, as depicted in FIG. 4, the timing of the partial release (402) coincides with a local minimum in the engine-out pollutant mass flow (410). Such a moment may represent an optimal point in time to open the third control valve (118) and apply additional pressure heating to the catalytic converter (132) because the amount of pollutant-filled exhaust from the engine (102) is low at that time and therefore the net amount of untreated exhaust that will exit the tailpipe (110) is emitted is low. FIG. 4 further depicts the engine-out pollutant mass flow (410) reaching a local maximum after partial release (402) and before the partial fill (404). Such a moment may represent an optimal time to close the third control valve (118), at least partially close the first control valve (114), and at least partially open the second control valve (116) in order to trap the increased amount of pollutant-filled exhaust and lower the net amount of untreated exhaust that will be emitted from the tailpipe (110).

Figure 5:
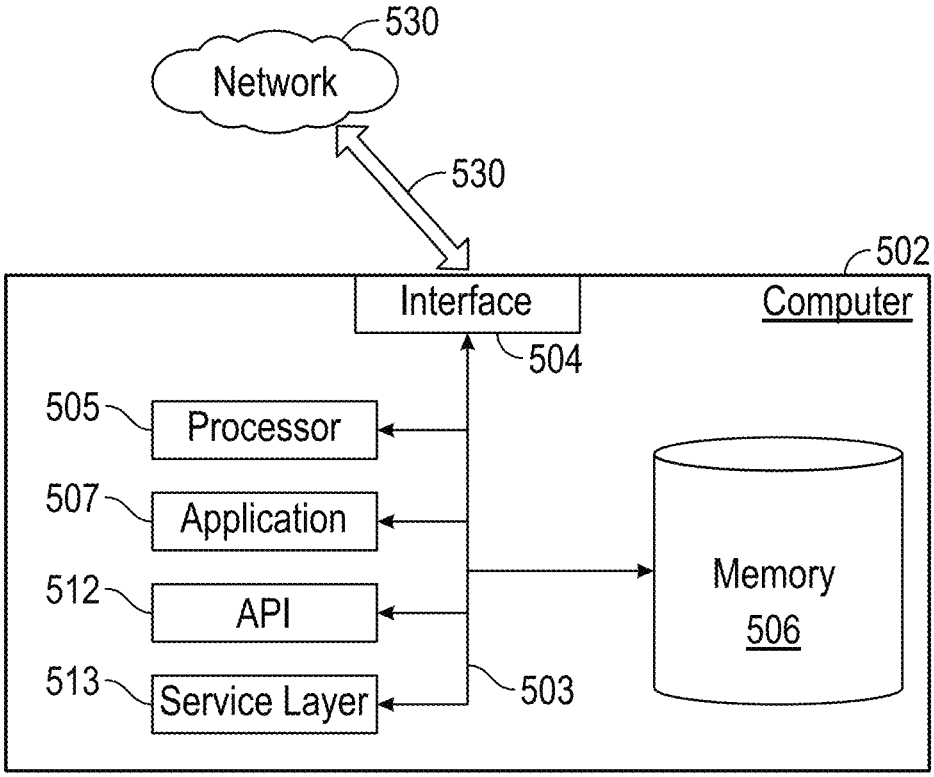
FIG. 5 depicts a system in accordance with one or more embodiments of the present disclosure.

Embodiments may be implemented on a computer system. FIG. 5 is a block diagram of a computer system (502) used to provide computational functionalities associated with described algorithms, methods, functions, processes, flows, and procedures as described in the instant disclosure, according to one or more embodiments. For example, the computer system (502) may be included as part of the ECU (112) or may be used in communication with the ECU (112). The illustrated computer (502) is intended to encompass any computing device such as a server, desktop computer, laptop/notebook computer, wireless data port, smart phone, personal data assistant (PDA), tablet computing device, one or more processors within these devices, or any other suitable processing device such as an edge computing device, including both physical or virtual instances (or both) of the computing device. An edge computing device is a dedicated computing device that is, typically, physically adjacent to the process or control with which it interacts. For example, the computational model (140) of the ECU (112) may be implemented on an edge computing device.

Additionally, the computer (502) may include a computer that includes an input device, such as a keypad, keyboard, touch screen, or other device that can accept user information, and an output device that conveys information associated with the operation of the computer (502), including digital data, visual, or audio information (or a combination of information), or a GUI.

The computer (502) can serve in a role as a client, network component, a server, a database or other persistency, or any other component (or a combination of roles) of a computer system for performing the subject matter described in the instant disclosure. In some implementations, one or more components of the computer (502) may be configured to operate within environments, including cloud-computing-based, local, global, or other environments (or a combination of environments).

At a high level, the computer (502) is an electronic computing device operable to receive, transmit, process, store, or manage data and information associated with the described subject matter. According to some implementations, the computer (502) may also include or be communicably coupled with an application server, e-mail server, web server, caching server, streaming data server, business intelligence (BI) server, or other server (or a combination of servers).

The computer (502) can receive requests over network (530) from a client application (for example, executing on another computer (502) and responding to the received requests by processing the said requests in an appropriate software application. In addition, requests may also be sent to the computer (502) from internal users (for example, from a command console or by other appropriate access method), external or third-parties, other automated applications, as well as any other appropriate entities, individuals, systems, or computers.

Each of the components of the computer (502) can communicate using a system bus (503). In some implementations, any or all of the components of the computer (502), both hardware or software (or a combination of hardware and software), may interface with each other or the interface (504) (or a combination of both) over the system bus (503) using an application programming interface (API) (512) or a service layer (513) (or a combination of the API (512) and service layer (513). The API (512) may include specifications for routines, data structures, and object classes. The API (512) may be either computer-language independent or dependent and refer to a complete interface, a single function, or even a set of APIs. The service layer (513) provides software services to the computer (502) or other components (whether or not illustrated) that are communicably coupled to the computer (502). The functionality of the computer (502) may be accessible for all service consumers using this service layer. Software services, such as those provided by the service layer (513), provide reusable, defined business functionalities through a defined interface. For example, the interface may be software written in JAVA, C++, or other suitable language providing data in extensible markup language (XML) format or another suitable format. While illustrated as an integrated component of the computer (502), alternative implementations may illustrate the API (512) or the service layer (513) as stand-alone components in relation to other components of the computer (502) or other components (whether or not illustrated) that are communicably coupled to the computer (502). Moreover, any or all parts of the API (512) or the service layer (513) may be implemented as a child or sub-modules of another software module, enterprise application, or hardware module without departing from the scope of this disclosure.

The computer (502) includes an interface (504). Although illustrated as a single interface (504) in FIG. 5, two or more interfaces (504) may be used according to particular needs, desires, or particular implementations of the computer (502). The interface (504) is used by the computer (502) for communicating with other systems in a distributed environment that are connected to the network (530). Generally, the interface (504) includes logic encoded in software or hardware (or a combination of software and hardware) and operable to communicate with the network (530). M ore specifically, the interface (504) may include software supporting one or more communication protocols associated with communications such that the network (530) or interface's hardware is operable to communicate physical signals within and outside of the illustrated computer (502).

The computer (502) includes at least one computer processor (505). Although illustrated as a single computer processor (505) in FIG. 5, two or more processors may be used according to particular needs, desires, or particular implementations of the computer (502). Generally, the computer processor (505) executes instructions and manipulates data to perform the operations of the computer (502), and any algorithms, methods, functions, processes, flows, and procedures as described in the instant disclosure.

The computer (502) also includes a memory (506) that holds data for the computer (502) or other components (or a combination of both) that can be connected to the network (530). The memory may be a non-transitory computer readable medium. For example, memory (506) can be a database storing data consistent with this disclosure. Although illustrated as a single memory (506) in FIG. 5, two or more memories may be used according to particular needs, desires, or particular implementations of the computer (502) and the described functionality. While memory (506) is illustrated as an integral component of the computer (502), in alternative implementations, memory (506) can be external to the computer (502).

The application (507) is an algorithmic software engine providing functionality according to particular needs, desires, or particular implementations of the computer (502), particularly with respect to functionality described in this disclosure. For example, application (507) can serve as one or more components, modules, applications, etc. Further, although illustrated as a single application (507), the application (507) may be implemented as multiple applications (507) on the computer (502). In addition, although illustrated as integral to the computer (502), in alternative implementations, the application (507) can be external to the computer (502).

There may be any number of computers (502) associated with, or external to, a computer system containing computer (502), wherein each computer (502) communicates over network (530). Further, the term "client," "user," and other appropriate terminology may be used interchangeably as appropriate without departing from the scope of this disclosure. Moreover, this disclosure contemplates that many users may use one computer (502), or that one user may use multiple computers (502).

Figure 6:
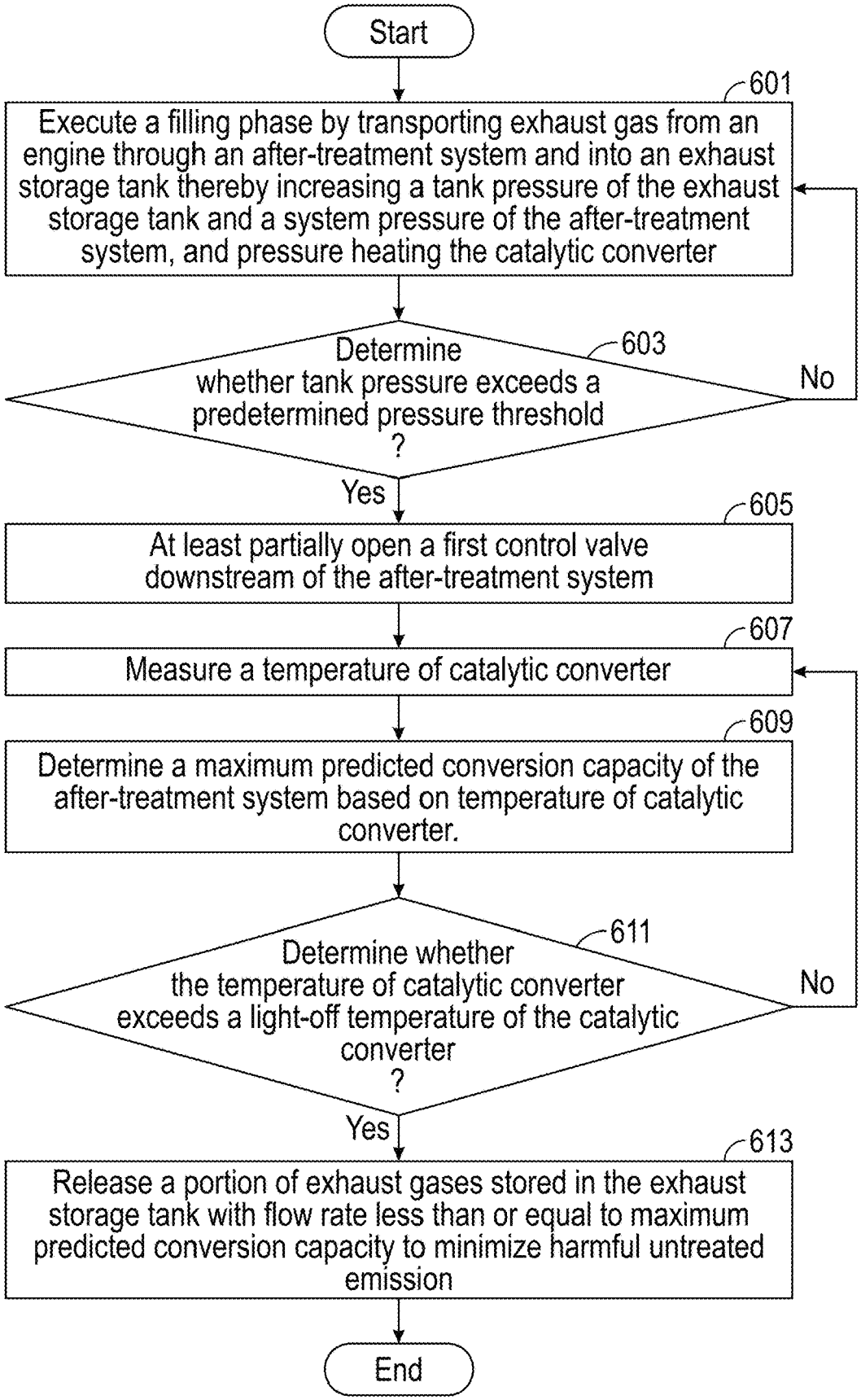
FIG. 6 depicts a flowchart of a method in accordance with one or more embodiments of the present disclosure.

FIG. 6 depicts a method in accordance with one or more embodiments. The method begins with step 601, which involves executing a filling phase by transporting exhaust gas from an engine (102) through an after-treatment system (106) including a catalytic converter (132) and into an exhaust storage tank (108) and increasing a tank pressure of the exhaust storage tank (108) and a system pressure of the after-treatment system (106), thereby pressure heating the catalytic converter (132). In step 601, the exhaust gas is received from the engine (102) at a first junction (124) disposed at a first location of an exhaust discharge line (104), and then transported the through the after-treatment system (106), which is disposed downstream of the first junction (124). Continuing with step 601, the exhaust gas then reaches a second junction (126) disposed at a second location of the exhaust discharge line (104) downstream of the after-treatment system (106). Step 601 yet further includes at least partially closing a first control valve (114) disposed downstream of the second junction (126) to direct the exhaust gas away from a tailpipe (110) and towards an exhaust recirculation line (130) fluidically coupled to the first junction (124) and the second junction (126) of the exhaust discharge line (104). The exhaust storage tank (108) is disposed in the exhaust discharge line (104).

Step 601 additionally includes opening a second control valve (116) disposed between the second junction (126) and the exhaust storage tank (108) and closing a third control valve (118) disposed between the pressurized exhaust storage tank (108) and the first junction (124). Each of the first control valve (114), the second control valve (116), and the third control valve (118) include butterfly valves having an aperture of configurable diameter occupying a state inclusively between open and closed. Step 601 also includes accumulating a portion of exhaust gases in the exhaust storage tank (108) thereby increasing a tank pressure of the exhaust storage tank (108), increasing a system pressure of the after-treatment system (106), and pressure heating the catalytic converter (132). Step 603 includes determining, with a pressure sensor (136), whether the tank pressure exceeds a predetermined pressure threshold. In response to the determination that the tank pressure exceeds the predetermined pressure threshold, the filling phase is ended in Step 605 by at least partially closing the second control valve (116) and at least partially opening the first control valve (114) downstream of the after-treatment system while maintaining the tank pressure. If the tank pressure does not exceed the predetermined pressure threshold, then the portion of exhaust gases continues to accumulate in the exhaust storage tank (108) as described in Step 601 until the predetermined pressure threshold is exceeded according to Step 603.

Step 607 includes obtaining a temperature of the catalytic converter using an after-treatment system temperature sensor (134). Step 609 includes determining a maximum predicted conversion capacity of the after-treatment system (106) based, at least in part, on the temperature of the catalytic converter (132). Step 611 includes determining whether the temperature of the catalytic converter (132) exceeds a light-off temperature of the catalytic converter (132). If the temperature of the catalytic converter (132) does not exceed the light-off temperature, then the system continues to operate without any changes and the temperature of the catalytic converter (132) is monitored with additional measurements according to Step 607, followed by Step 609. If the temperature of the catalytic converter (132) does exceed the light-off temperature, then at Step 613, a portion of exhaust gases stored in the exhaust storage tank (108) is released in response to the determination that the temperature of the catalytic converter (132) exceeds the light-off temperature. In one or more embodiments, Step 613 may be achieved by opening the third control valve (118) to release the portion of exhaust gases. The amount to which the third control valve (118) is opened is such that the total flow of exhaust gas, both from the engine (102) and the exhaust storage tank (108), provides a flow rate across a predetermined unit of time less than or equal to the maximum predicted conversion capacity of the after-treatment system. By ensuring that the total flow rate across the predetermined unit of time is less than the maximum predicted conversion capacity, the emission of harmful untreated exhaust gases is minimized.

Embodiments of the present disclosure present at least the following advantages. Some of the advantages may be better understood in reference to existing strategies for heating catalytic converters before they reach their light-off temperatures. For example, some strategies include using artificial heating mechanisms, such as electrical heaters or burner systems. Electrical heaters require a high voltage electric system architecture on the vehicle (e.g., batteries, power electronics, 48V, or higher for heavy-duty vehicle application). Not only do such electrical heaters increase cost, but they often pose durability challenges. Burner systems applied to catalytic converters require additional air-fuel feed and ignition systema arranged before the catalytic converter, and these additional combustion systems produce their own pollutant emissions which must be dealt with. Collectively, both of these solutions add cost and complexity to a vehicle which further reduces the cost competitiveness of an internal combustion engine in view of the stringent emission requirements of the present and future. By contrast, embodiments of the present disclosure are extremely durable, relying only on selectively controllable valves and a pressurized storage container. As such, very little additional cost is added and the exhaust system disclosed herein is expected to outlast the lifetime of the after-treatment system, including the catalytic converter, and perhaps the engine itself.

Although only a few example embodiments have been described in detail above, those skilled in the art will readily appreciate that many modifications are possible in the example embodiments without materially departing from this invention. For example, the remaining capacity of the catalytic converter may be determined with the use of a NOx sensor, rather than being determined using a computer model. Furthermore, the control valves may be controlled based upon the expected conversion efficiency of the catalytic converter for a particular fluid flow, rather than the remaining conversion capacity. In addition, many modifications will be appreciated by those skilled in the art to adapt a particular instrument, situation, or material to embodiments of the disclosure without departing from the essential scope thereof. Accordingly, all such modifications are intended to be included within the scope of this disclosure as defined in the following claims.

Furthermore, the compositions described herein may be free of any component, or composition not expressly recited or disclosed herein. Any method may lack any step not recited or disclosed herein. Likewise, the term "comprising" is considered synonymous with the term "including." Whenever a method, composition, element or group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa.

Unless otherwise indicated, all numbers expressing quantities used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by one or more embodiments described herein. At the very least, and not as an attempt to limit the application of the doctrine of equivalents to the scope of the claim, each numerical parameter should at least be construed in light of the number of reported significant digits and by applying ordinary rounding techniques.

What is claimed is:

1. A system comprising:

an exhaust discharge line configured to receive exhaust gases from an engine;

a first junction disposed at a first location along the exhaust discharge line;

a second junction disposed at a second location along the exhaust discharge line downstream of the first location and fluidically coupled to a tailpipe;

an after-treatment system disposed between the first junction and the second junction, the after-treatment system configured to reduce pollutants comprising Nitrogen Oxides (NOx) in the exhaust gases from the engine using a catalytic converter;

an exhaust recirculation line fluidically coupled to the first junction and the second junction of the exhaust discharge line, a pressurized exhaust storage tank disposed along the exhaust recirculation line;

a first control valve disposed in the exhaust discharge line downstream of the second junction;

a second control valve disposed in the exhaust recirculation line between the second junction and the pressurized exhaust storage tank;

a third control valve disposed in the exhaust recirculation line between the pressurized exhaust storage tank and the first junction;

wherein each of the first control valve, the second control valve, and the third control valve comprise butterfly valves having an aperture of configurable diameter occupying a state inclusively between open and closed; and an electronic control unit (ECU) comprising a memory and at least one processor, where the ECU is communicatively coupled to the after-treatment system, the first control valve, the second control valve, and the third control valve, and the processor is configured to execute commands stored on the memory comprising:

executing a filling phase by at least partially closing the first control valve, opening the second control valve, and closing the third control valve to accumulate a portion of the exhaust gases in the pressurized exhaust storage tank, thereby increasing a tank pressure of the pressurized exhaust storage tank, and increasing a system pressure of the after-treatment system and pressure heating the catalytic converter, determining, with a pressure sensor, whether the tank pressure exceeds a predetermined pressure threshold, ending the filling phase by at least partially closing the second control valve and at least partially opening the first control valve, while maintaining the tank pressure, in response to the determination that the tank pressure exceeds the predetermined pressure threshold, measuring a temperature of the catalytic converter, determining a maximum predicted conversion capacity of the after-treatment system based, at least in part, on the temperature of the catalytic converter, determining whether the temperature of the catalytic converter exceeds a light-off temperature of the catalytic converter, and opening the third control valve to release the portion of exhaust gases in response to the determination that the temperature of the catalytic converter exceeds the light-off temperature, wherein the third control valve is opened to an aperture that provides a flow rate across a predetermined unit of time less than or equal to the maximum predicted conversion capacity of the after-treatment system.

2. The system of claim 1, wherein opening the third control valve, the processor executes a recirculation phase by:

partially opening the third control valve in response to the determination that the temperature of the catalytic converter is less than the light-off temperature; and circulating the portion of exhaust gases stored in the pressurized storage tank through the exhaust recirculation line and through the after-treatment system;

wherein circulating the portion of exhaust gases further pressure-heats the catalytic converter due to a gas pressure of the portion of exhaust gases.

3. The system of claim 1, wherein the maximum predicted conversion capacity is determined using a computational model of the after-treatment system, wherein the computational model of the after-treatment system is defined by a set of after-treatment parameters comprising a size of the catalytic converter.

4. The system of claim 1, wherein the predetermined unit of time is an average amount of time required for exhaust gases to traverse the after-treatment system.

5. The system of claim 3, wherein the set of after-treatment parameters further comprises an expected chemical composition of the exhaust gases.

6. The system of claim 1, wherein the after-treatment system comprises:

an oxidation catalyst configured to oxidize carbon monoxide (CO) in the exhaust gases;

a particulate filter configured to remove soot from the exhaust gases; and a selective catalytic reduction (SCR) catalyst configured to convert the NOx in the exhaust gases in Nitrogen (N) and water ($H_2O$).

7. The system of claim 1, wherein the engine is a component of a light-duty vehicle and has a volume within 20% of 2 L, inclusively.

8. The system of claim 7, wherein the pressurized exhaust storage tank has a volume within 20% of 37.5 L, inclusively, and the predetermined pressure threshold is 2 bar.

9. The system of claim 1, wherein the processor is further configured to:

obtain an engine temperature from an engine temperature sensor;

compare the engine temperature to an engine temperature threshold; and execute the commands in response to the engine temperature being lower than the engine temperature threshold.

10. The system of claim 9, wherein the processor is further configured to execute the commands in response to the engine temperature being greater than the engine temperature threshold.

11. A method comprising:

executing a filling phase by:

receiving exhaust gas from an engine at a first junction disposed at a first location of an exhaust discharge line, transporting the exhaust gas through an after-treatment system disposed downstream of the first junction and to a second junction, wherein the second junction is disposed at a second location of the exhaust discharge line downstream of the after-treatment system, at least partially closing a first control valve disposed downstream of the second junction to direct the exhaust gas away from a tailpipe and towards an exhaust recirculation line fluidically coupled to the first junction and the second junction of the exhaust discharge line, wherein the exhaust recirculation line comprises a pressurized exhaust storage tank, opening a second control valve disposed between the second junction and the pressurized exhaust storage tank, closing a third control valve disposed between the pressurized exhaust storage tank and the first junction, wherein each of the first control valve, the second control valve, and the third control valve comprise butterfly valves having an aperture of configurable diameter occupying a state inclusively between open and closed, accumulating a portion of exhaust gases in the pressurized exhaust storage tank thereby increasing a tank pressure of the pressurized exhaust storage tank, increasing a system pressure of the after-treatment system, and pressure heating a catalytic converter, and determining, with a pressure sensor, whether the tank pressure exceeds a predetermined pressure threshold, ending the filling phase by:

at least partially closing the second control valve and at least partially opening the first control valve, while maintaining the tank pressure, in response to the determination that the tank pressure exceeds the predetermined pressure threshold;

obtaining a temperature of the catalytic converter using an after-treatment system temperature sensor, determining a maximum predicted conversion capacity of the after-treatment system based, at least in part, on the temperature of the catalytic converter, determining whether the temperature of the catalytic converter exceeds a light-off temperature of the catalytic converter, and opening the third control valve to release the portion of exhaust gases in response to the determination that the temperature of the catalytic converter exceeds the light-off temperature, wherein the third control valve is opened to an aperture that provides a flow rate across a predetermined unit of time less than or equal to the maximum predicted conversion capacity of the after-treatment system.

12. The method of claim 11, further comprising executing a recirculation phase by:

partially opening the third control valve in response to the determination that the temperature of the catalytic converter is less than the light-off temperature; and circulating the portion of exhaust gases stored in the pressurized storage tank through the exhaust recirculation line and through the after-treatment system;

wherein circulating the portion of exhaust gases further pressure-heats the catalytic converter due to a gas pressure of the portion of exhaust gases.

13. The method of claim 11, wherein the maximum predicted conversion capacity is determined using a computational model of the after-treatment system, wherein the computational model of the after-treatment system is defined by a set of after-treatment parameters comprising a size of the catalytic converter.

14. The method of claim 13, wherein the set of after-treatment parameters further comprises an expected chemical composition of the exhaust gas.

15. The method of claim 11, wherein the after-treatment system comprises:

an oxidation catalyst configured to oxidize carbon monoxide (CO) in the exhaust gases;

a particulate filter configured to remove soot from the exhaust gases; and a selective catalytic reduction (SCR) catalyst configured to convert NOx in the exhaust gases into Nitrogen and water.

16. The method of claim 11, wherein the engine is a component of a light-duty vehicle and has a volume within 20% of 2 L, inclusively.

17. The method of claim 16, wherein the pressurized exhaust storage tank has a volume within 20% of 37.5 L, inclusively and the predetermined pressure threshold is 2 bar.

18. The method of claim 13, wherein the first control valve, the second control valve, and the third control valve are opened and closed according to commands from an electronic control unit (ECU) comprising a processor and a memory, wherein the commands are stored on the memory.

19. The method of claim 11, further comprising:

obtaining an engine temperature from an engine temperature sensor;

comparing the engine temperature an engine temperature threshold; and adjusting the states of the first control valve, the second control valve, and the third control valve in response to the engine temperature being lower than the engine temperature threshold.

20. The method of claim 19, wherein the states of the first control valve, the second control valve, and the third control valve are adjusted in response to the engine temperature being greater than the engine temperature threshold.

* * * * *